US006802356B2

(12) United States Patent
Lin

(10) Patent No.: US 6,802,356 B2
(45) Date of Patent: Oct. 12, 2004

(54) WINDOW BLIND HAVING A RESTRAINABLE BOTTOM RAIL

(76) Inventor: Shih-Ming Lin, No. 33, Nan-Ching-Nung-Chang, Ching-Ho Tsun, Shui-Shang, Chia-Yi Hsien (TW)

( * ) Notice: Subject to any disclaimer, the term of this patent is extended or adjusted under 35 U.S.C. 154(b) by 0 days.

(21) Appl. No.: 10/355,671

(22) Filed: Jan. 31, 2003

(65) Prior Publication Data

US 2004/0149398 A1 Aug. 5, 2004

(51) Int. Cl.[7] ..... E06B 9/30
(52) U.S. Cl. ..... 160/168.1 R; 160/173 R
(58) Field of Search ..... 160/168.1 R, 173 R, 160/177 R, 178.1 R, 84.01, 107, 34

(56) References Cited

U.S. PATENT DOCUMENTS 3,795,267 A * 3/1974 Debs ..... 160/168.1 R
4,293,127 A * 10/1981 Dudley ..... 482/120
4,825,929 A * 5/1989 Haines ..... 160/84.06
5,178,200 A * 1/1993 Hagen ..... 160/107
5,515,898 A * 5/1996 Alcocer ..... 160/84.02
5,533,559 A * 7/1996 Judkins ..... 160/84.06
6,095,222 A * 8/2000 Voss ..... 160/84.05
6,550,522 B1 * 4/2003 Lennon et al. ..... 160/168.1 R
2002/0157796 A1 * 10/2002 Judkins ..... 160/84.04
2003/0192653 A1 * 10/2003 Nien ..... 160/168.1 R
2003/0196765 A1 * 10/2003 Ciuca et al. ..... 160/170

* cited by examiner

*Primary Examiner*—Bruce A. Lev
(74) *Attorney, Agent, or Firm*—Ladas & Parry LLP

(57) ABSTRACT

A window blind includes a hollow horizontal headrail, a slat unit, a hollow bottom rail, and a pair of pull ropes. The slat unit includes parallel slats disposed under and parallel to the headrail. Each slat has two spaced apart holes. The bottom rail is disposed under and parallel to the slats. Each pull rope has a vertical section which passes through one of the holes in each of the slats, a turning section which extends below the vertical section within the bottom rail and which is inclined from the vertical section, a mounting section which extends inclinedly from the turning section, which extends out from the bottom rail and which is to be fixed to a wall below the bottom rail, and a pulling section which extends above the vertical section and which is suspended from the headrail.

6 Claims, 6 Drawing Sheets

WINDOW BLIND HAVING A RESTRAINABLE BOTTOM RAIL

BACKGROUND OF THE INVENTION

1. Field of the Invention

The invention relates to a window blind, more particularly to a window blind having a retrainable bottom rail.

2. Description of the Related Art

A conventional window blind includes a hollow horizontal headrail, a plurality of slats disposed under and parallel to the headrail, a bottom rail disposed under and parallel to the slat unit, and a pair of pull ropes. Each of the pull ropes has a vertical section that passes through a hole formed in a respective end portion of each of the slats, a mounting end that is fastened to the bottom rail, and an actuator end that extends out of the headrail. The actuator end is suspended from the headrail and is operable to raise and lower the slats. Although the conventional window blind achieves the purpose of blocking light and vision into a room when the slats are lowered, there are certain drawbacks associated with the conventional window blind. For instance, since the bottom rail is not retrained, strong gusts of wind may cause the bottom rail to sway back and forth, which creates undesirable noise when the bottom rail hits a wall. Another drawback is that the actuator ends of the pull ropes lengthen when the slat are raised and are easily reached by children, which is dangerous in view of possible entanglement.

SUMMARY OF THE INVENTION

Therefore; the object of the present invention is to provide a window blind that has a retrainable bottom rail so as to overcome the aforesaid drawbacks of the prior art.

According to the present invention, a window blind comprises a hollow horizontal headrail, a slat unit, a hollow bottom rail, and a pair of pull ropes. The slat unit includes a plurality of parallel slats disposed under and parallel to the headrail. Each of the slats has two spaced apart holes. The hollow bottom rail is disposed under and parallel to the slats. Each of the pull ropes has a vertical section which passes through one of the holes in each of the slats, a turning section which extends below the vertical section within the bottom rail and which is inclined from the vertical section, a mounting section which extends inclinedly from the turning section, which extends out from the bottom rail and which is adapted to be fixed to a wall below the bottom rail, and a pulling section which extends above the vertical section and which is suspended from the headrail. The pulling section is operable so as to set a tension level on the vertical, turning and mounting sections. The bottom rail has two spaced apart entrance holes adjacent to the slat unit, and two spaced apart exit holes provided below the entrance holes. The vertical section ends at one of the entrance holes. The turning section extends from one of the entrance holes to one of the exit holes and provides a frictional retention force to retain the bottom rail at a desired height.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
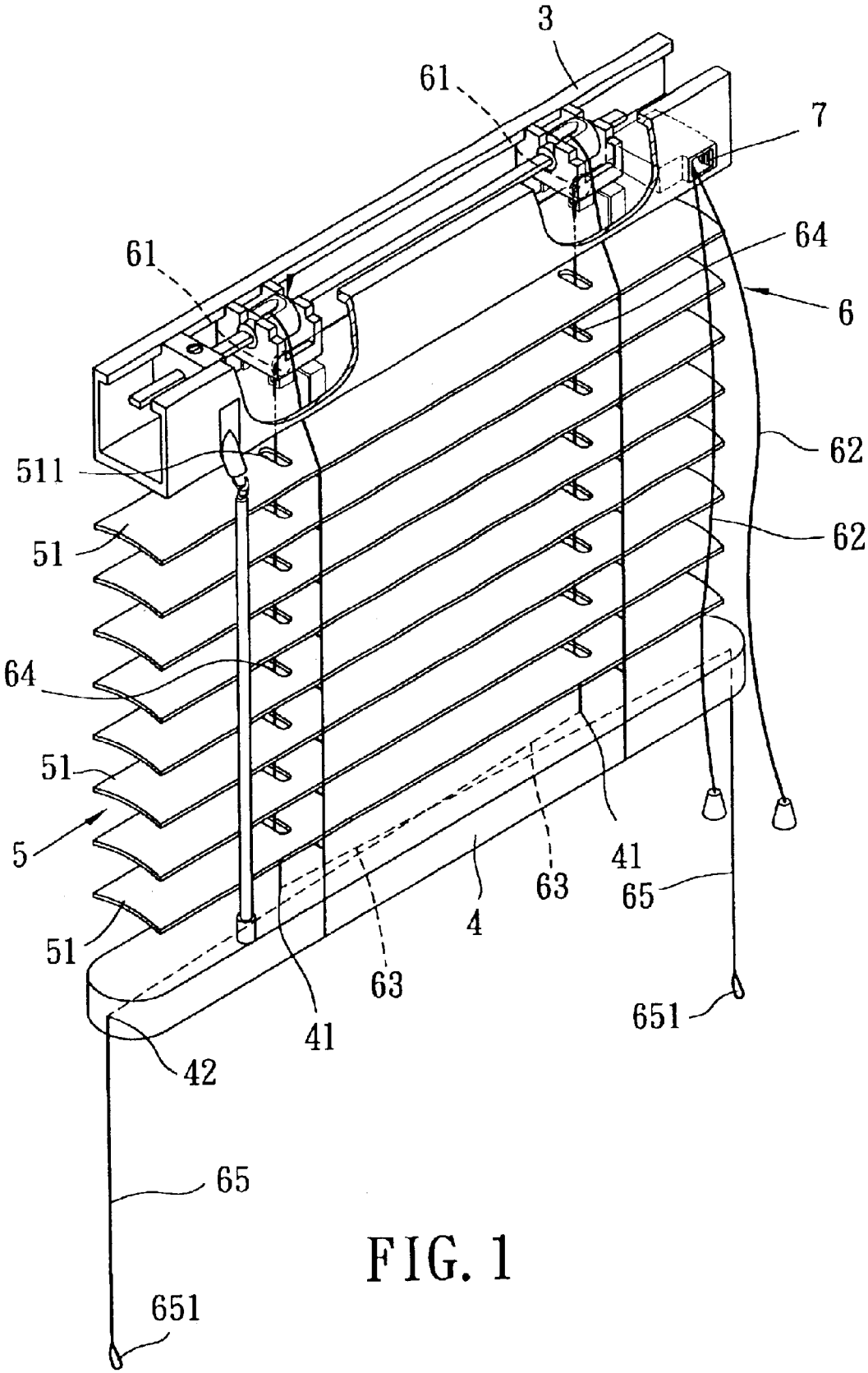
FIG. 1 is a perspective view of the first preferred embodiment of a window blind according to the present invention.

Before the present invention is described in greater detail, it should be noted that like elements are denoted by the same reference numerals throughout the disclosure.

Referring to FIG. 1, the first preferred embodiment of a window blind according to the present invention is shown to include a hollow horizontal headrail 3, a slat unit 5, a hollow bottom rail 4, and a pair of pull ropes 6.

The headrail 3 has a U-shaped cross-section along a vertical plane transverse to a longitudinal direction of the headrail 3, and is adapted to be mounted on a wall (not shown) above a window (not shown). The slat unit 5 includes a plurality of parallel slats 51 disposed under and parallel to the headrail 3. Each of the slats 51 has two spaced apart holes 511. In this embodiment, the slats 51 are formed as separate strips. Generally, when the slat unit 5 is lowered, an angle-adjusting mechanism can be operated to tilt the slats 51. However, since the feature of the present invention does not reside in the specific construction of the angle-adjusting mechanism, a detailed description thereof is omitted herein for the sake of brevity. The bottom rail 4 is disposed under and parallel to the slats 51, has left and right ends, two spaced apart entrance holes 41 adjacent to the slat unit 5, and two spaced apart exit holes 42 provided below the entrance holes 41. In this embodiment, the exit holes 42 are respectively disposed at the left and right ends of the bottom rail 4, and the entrance holes 41 are disposed between the exit holes 42. Each of the pull ropes 6 has vertical, turning, mounting, and pulling sections 64, 63, 65, 62. The vertical section 64 passes through one of the holes 511 in each of the slats 51 and ends at one of the entrance holes 41. The turning section 63 extends below the vertical section 64 within the bottom rail 4 from one of the entrance holes 41 to one of the exit holes 42, and inclines from the vertical section 64 so as to provide a frictional retention force to retain the bottom rail 4 at a desired height. The mounting section 65 extends inclinedly from the turning section 63, extends out from the bottom rail 4, and is adapted to be fixed to a wall (not shown) below the bottom rail 4. The pulling section 62 extends above the vertical section 64, is suspended from the headrail 3, and is operable so as to set a tension level on the vertical, turning and mounting sections 64, 63, 65. Preferably, the mounting section 65 has a distal end formed with a loop 651. The loop 651 can be fastened to the wall using a hook, a nail, a screw, etc. In this embodiment, the mounting section 65 extends perpendicularly to the bottom rail 4. Alternatively, the mounting section 65 may extend at an angle with respect to the bottom rail 4.

The window blind further includes a pull-rope locking device 7 mounted inside and at an end portion of the headrail 3. The pulling sections 62 of the pull ropes 6 are connected to the pull-rope locking device 7. The pull-rope locking device 7 is operable so as to lock releasably the pulling sections 62. Since the construction of the pull-rope locking device 7 is known to those skilled in the art, a detailed description of the same will be dispensed with herein for the sake of brevity.

Figure 2:
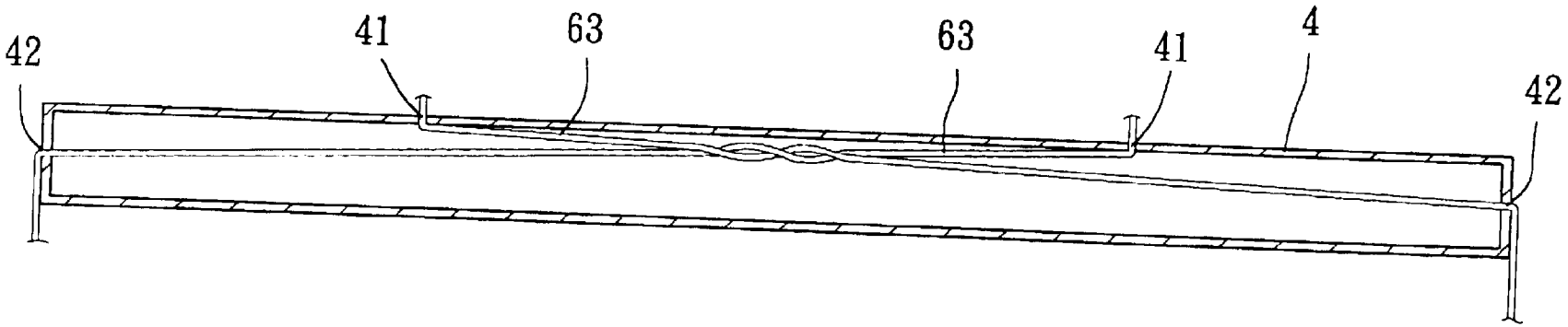
FIG. 2 is a fragmentary sectional view of the pull ropes being twisted together within the bottom rail of FIG. 1.

With further reference to FIG. 2, the turning sections 63 of the pull ropes 6 turn toward each other within the bottom rail 4 when extending respectively from the entrance holes 41 to the exit holes 42. In this embodiment, the turning sections 63 are twisted together to enhance the frictional retention force. Alternatively, the turning sections 63 can merely cross each other within the bottom rail 4.

The window blind further includes two rotary wheels 61 journalled in two opposite end portions of the headrail 3 for guiding the vertical sections 64 of the pull ropes 6, respectively.

Figure 3:
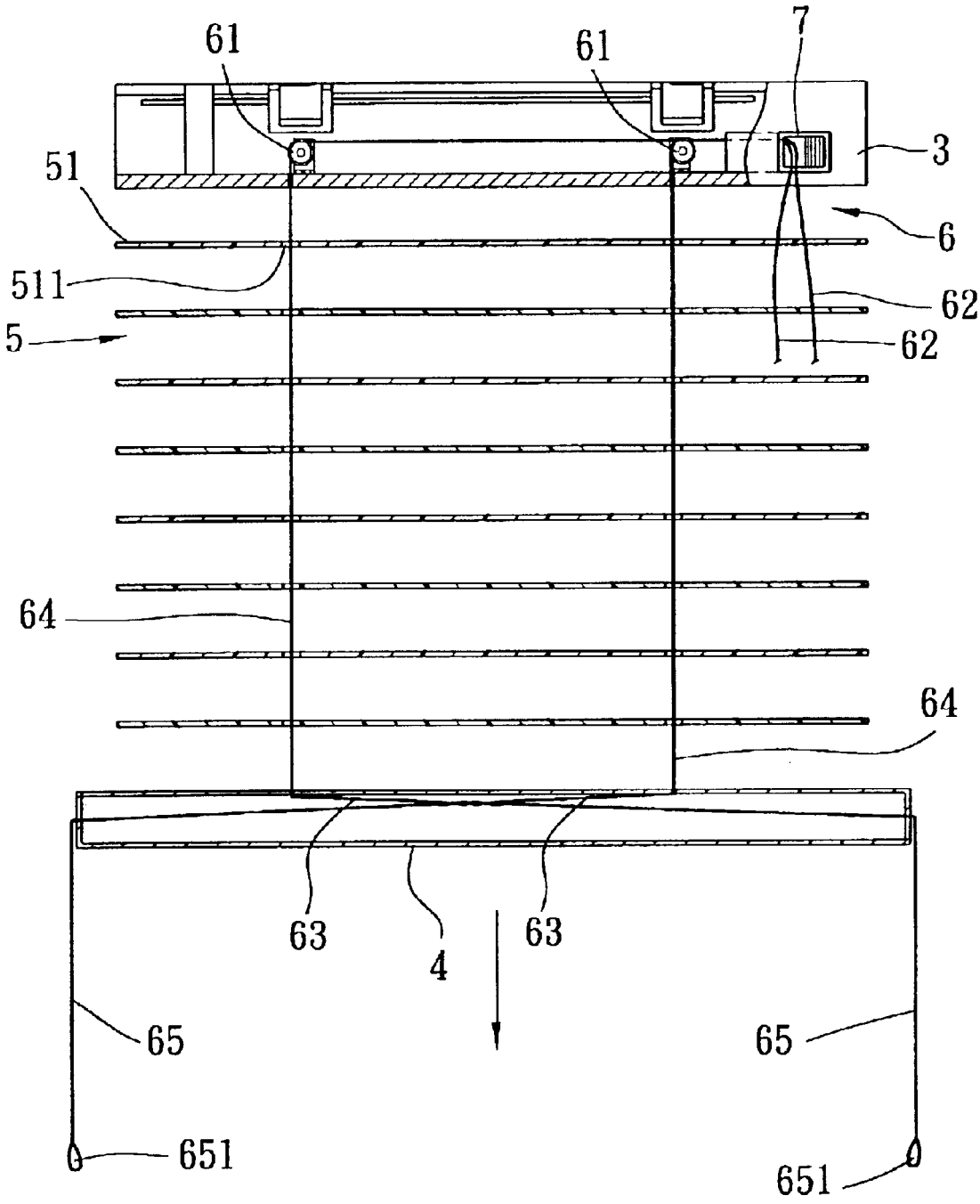
FIG. 3 is a schematic view of the first preferred embodiment, illustrating downward movement of the bottom rail.
Figure 4:
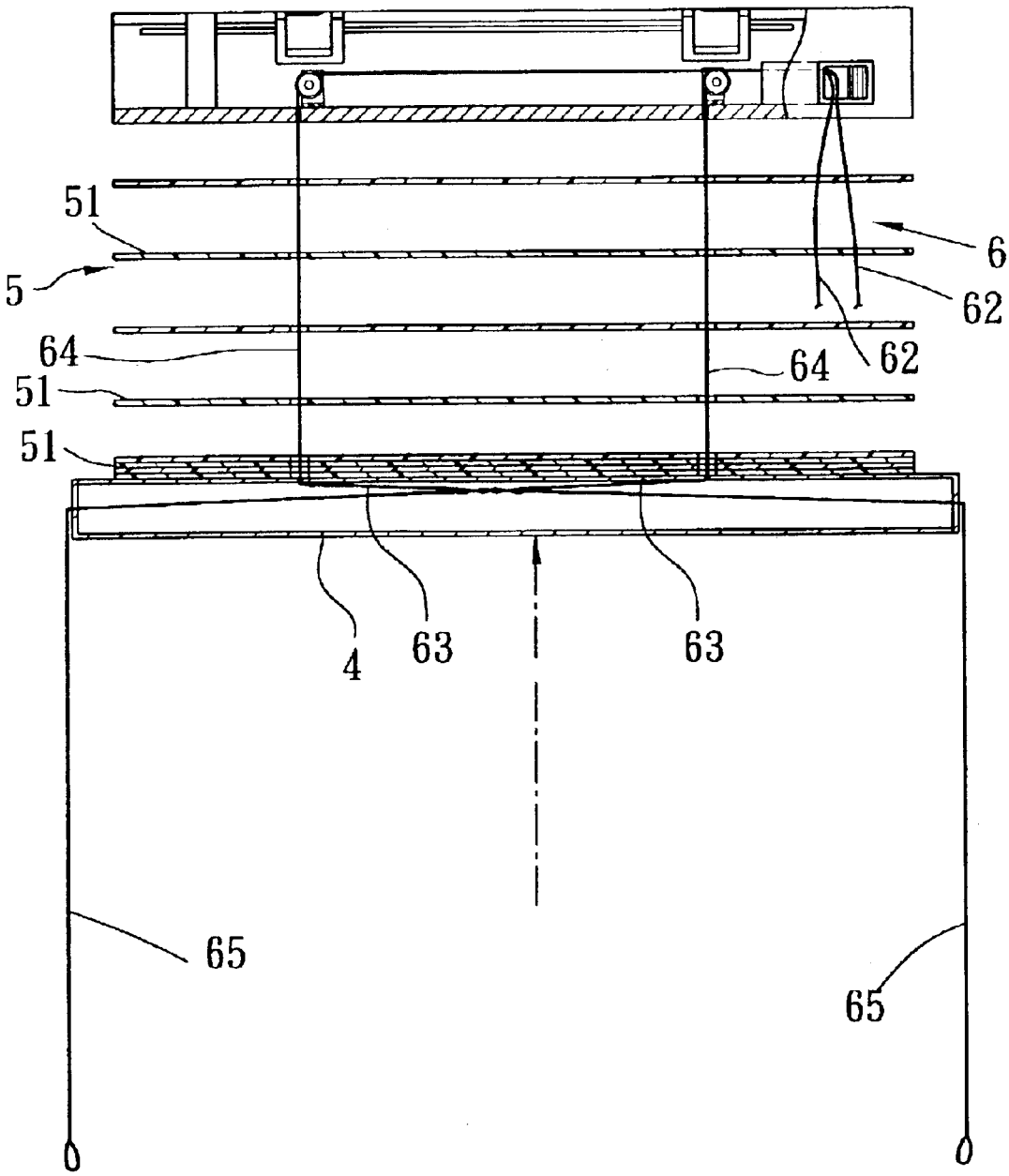
FIG. 4 is a schematic view of the first preferred embodiment, illustrating upward movement of the bottom rail.

In use, the loops 651 of the mounting sections 65 are first fastened on the wall at a predetermined height. The pulling sections 62 are then pulled to a desired tension level and locked by the pull-rope locking device 7. As such, swaying movement of the bottom rail 4 and the slat unit 5 due to wind may be avoided. In addition, as illustrated in FIGS. 3 and 4, the bottom rail 4 can be pushed upwardly or pulled downwardly to raise or lower the slat unit 51. The turning sections 63 of the pull ropes 6 permit retention of the bottom rail 4 at a desired position. It is noted that when the bottom rail 4 is raised, the lengths of the mounting sections 65 and the vertical sections 64 lengthen and shorten, respectively, while the lengths of the pulling sections 62 are maintained. Therefore, the pulling sections 62 can be fixed in a place that is out of reach of children. Moreover, the bottom rail 4 can be raised or lowered to any position without affecting the tension level. Further, when the vertical, turning and mounting sections 64, 63, 65 of the pull ropes 6 loose tautness due to overuse and the tension level becomes lax, the pulling sections 62 can be readjusted to set the tension back to the desired level.

Figure 5:
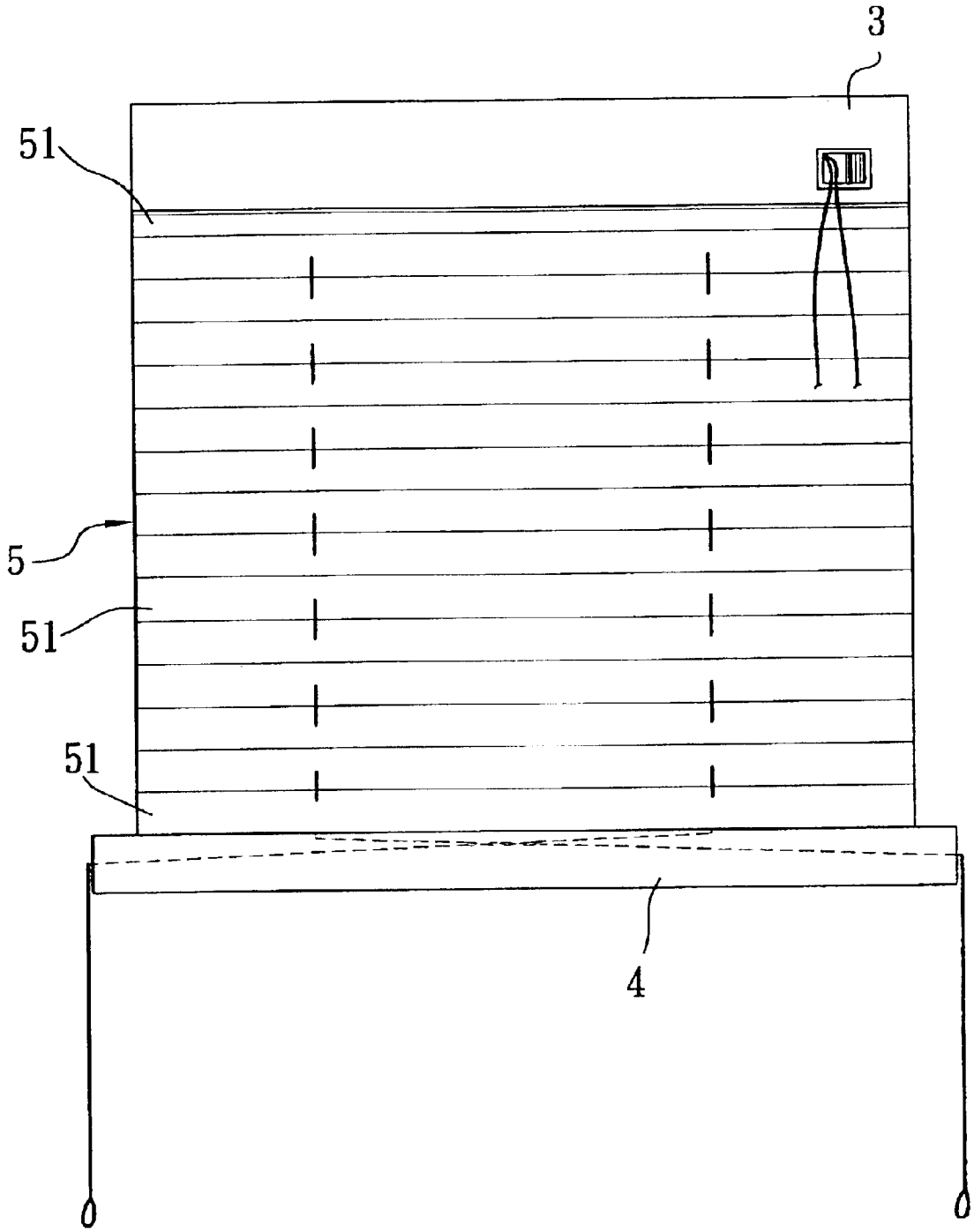
FIG. 5 is a schematic view of the second preferred embodiment of a window blind according to the present invention.
Figure 6:
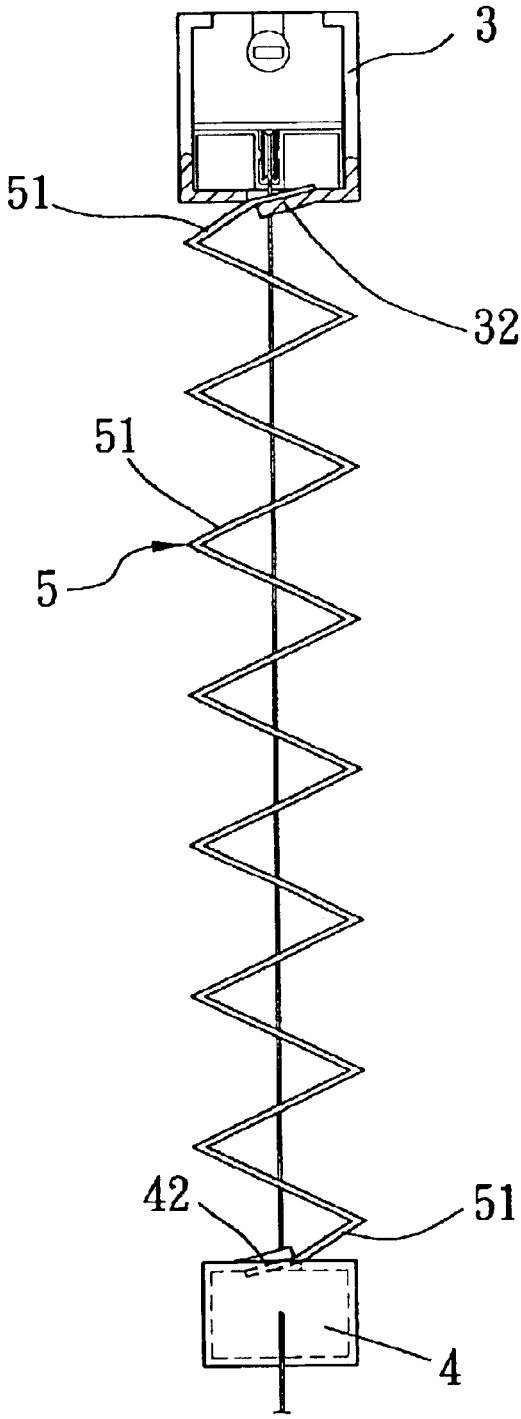
FIG. 6 is a side view of the second preferred embodiment.

FIGS. 5 and 6 illustrate the second preferred embodiment of a window blind according to the present invention. When compared with the previous preferred embodiment, the slat unit 5 is formed as a pleated shade that has a plurality of pleats, and the slats 51 are interconnected by the pleats. Preferably, the slat unit 5 is made from a single piece of sheet material, such as of paper, cloth, plastic, etc.

The window blind further includes a fastener unit. In this embodiment, the fastener unit includes a pair of clamps 32, 42 for fastening an uppermost one of the slats 51 to the headrail 3, and a lowermost one of the slats 51 on the bottom rail 4. Each of the clamps 32, 42 extends respectively along the longitudinal direction of the headrail 3 and the bottom rail 4. Since the operation of the second preferred embodiment is similar to that described hereinabove in connection with the previous preferred embodiment, a detailed description of the same will be dispensed with herein for the sake of brevity.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A window blind comprising:

a hollow horizontal headrail;

a slat unit including a plurality of parallel slats disposed under and parallel to said headrail, each of said slats having two spaced apart holes;

a hollow bottom rail disposed under and parallel to said slats; and a pair of pull ropes having a vertical section which passes through one of said holes in each of said slats, a turning section which extends below said vertical section within said bottom rail and which is inclined from said vertical section, a mounting section which extends and is inclined from said turning section, which extends out from said bottom rail and which is adapted to be fixed to a wall below said bottom rail, and a pulling section which extends above said vertical section and which is suspended from said headrail, said pulling section being operable so as to set a tension level on said vertical, turning and mounting sections;

wherein said bottom rail has two spaced apart entrance holes adjacent to said slat unit, and two spaced apart exit holes provided below said entrance holes, said vertical section ending at one of said entrance holes, said turning section extending from one of said entrance holes to one of said exit holes, said turning section providing a frictional retention force to retain said bottom rail at a desired height, wherein said bottom rail has a left end and a right end, said exit holes being respectively disposed at said left and right ends, said entrance holes being disposed between said exit holes;

wherein said turning sections of said pull ropes turn toward each other when extending respectively from said entrance holes to said exit holes; and wherein said turning sections cross each other and are twisted together within said bottom rail.

2. The window blind as claimed in claim 1, further comprising a pull-rope locking device mounted inside said headrail, said pulling section being connected to said pull-rope locking device, said pull-rope locking device being operable so as to lock releasably said pulling section.

3. The window blind as claimed in claim 1 wherein said slats are formed as separate strips.

4. The window blind as claimed in claim 1, further comprising rotary wheels mounted in said headrail for guiding said pull ropes, respectively.

5. The window blind as claimed in claim 1, wherein said slat unit is formed as a pleated shade, which has a plurality of pleats, said slats being interconnected by said pleats.

6. The window blind as claimed in claim 5, further comprising a faster unit for fastening an uppermost one said slats to said headrail, and a lowermost one of said slats on said bottom rail.

* * * * *